US008054981B2

(12) United States Patent
Röden et al.

(10) Patent No.: US 8,054,981 B2
(45) Date of Patent: Nov. 8, 2011

(54) ENERGY DEPENDENT QUANTIZATION FOR EFFICIENT CODING OF SPATIAL AUDIO PARAMETERS

(75) Inventors: Jonas Röden, Solna (SE); Jonas Engdegard, Stockholm (SE); Heiko Purnhagen, Sundbyberg (SE); Jeroen Breebaart, Eindhoven (NL); Erik Schuijers, Eindhoven (NL); Steven van de Par, Eindhoven (NL); Johannes Hilpert, Nürnberg (DE); Jürgen Herre, Buckenhof (DE)

(73) Assignees: Coding Technologies AB, Stockholm (SE); Koninklijke Philips Electronics N.V., Eindhoven (NL); Fraunhofer-Gesellschaft zur Foerderung der Angewandten Forshung E.V., Munich (DE)

( * ) Notice: Subject to any disclaimer, the term of this patent is extended or adjusted under 35 U.S.C. 154(b) by 1550 days.

(21) Appl. No.: 11/406,631

(22) Filed: Apr. 19, 2006

(65) Prior Publication Data

US 2007/0016416 A1 Jan. 18, 2007

Related U.S. Application Data

(63) Continuation of application No. PCT/EP2006/003284, filed on Apr. 10, 2006.

(60) Provisional application No. 60/672,943, filed on Apr. 19, 2005.

(51) Int. Cl.
*H04R 5/00* (2006.01)

(52) U.S. Cl. ..... 381/23; 381/22

(58) Field of Classification Search ..... 381/22, 381/23; 700/500–504; 369/4–5
See application file for complete search history.

(56) References Cited

U.S. PATENT DOCUMENTS

| | | | | |
|---|---|---|---|---|
| 6,134,200 | A | 10/2000 | Timmermans | |
| 7,382,886 | B2 * | 6/2008 | Henn et al. | 381/23 |
| 7,447,629 | B2 | 11/2008 | Breebaart | |
| 7,613,609 | B2 | 11/2009 | Makino | |
| 7,627,482 | B2 | 12/2009 | Tsuji et al. | |

FOREIGN PATENT DOCUMENTS

| | | | |
|---|---|---|---|
| JP | 2003337598 | A | 11/2003 |
| JP | 2004309921 | A | 11/2004 |

(Continued)

OTHER PUBLICATIONS

"Parametric Coding of Stereo Audio" (Breebaart, et al.), EURASIP Journal on Applied Signal Processing 2005:9, pp. 1305-1322.

(Continued)

*Primary Examiner* — Xu Mei
(74) *Attorney, Agent, or Firm* — Laurence A. Greenberg; Werner H. Stemer; Ralph E. Locher

(57) ABSTRACT

Parameters being a measure for a characteristic of a channel or of a pair of channels, wherein the parameter is a measure for a characteristic of the channel or of the pair of channels with respect to another channel of a multi-channel signal can be quantized more efficiently using a quantization rule that is generated based on a relation of an energy measure of the channel or the pair of channels and an energy measure of the multi-channel signal. With generation of the quantization rule taking into account a psycho acoustic approach, the size of an encoded representation of the multi-channel signal can be decreased by coarser quantization without significantly disturbing the perceptual quality of the multi-channel signal when reconstructed from the encoded representation.

26 Claims, 10 Drawing Sheets

FOREIGN PATENT DOCUMENTS

| | | | |
|---|---|---|---|
| JP | 2004535145 | T | 11/2004 |
| JP | 2005533426 | T | 11/2005 |
| JP | 2006528482 | T | 12/2006 |
| RU | 2 073 913 | C1 | 2/1997 |
| WO | 2004/072956 | A1 | 8/2004 |

OTHER PUBLICATIONS

"Binaural Cue Coding: A Novel and Efficient Representation of Spatial Audio" (Faller, et al.), dated May 2002, pp. 1841-1844.

"Binaural Cue Coding Applied to Stereo and Multi-Channel Audio Compression" (Faller, et al.), AES Convention Paper 5574, dated May 2002, pp. 1-9.

"Estimation of Auditory Spatial Cues for Binaural Cue Coding" (Baumgarte, et al.), dated May 2002.

"High-quality Parametric Spatial Audio Coding at Low Bit Rates" (Breebaart, et al.), AES Convention Paper, dated May 2004, pp. 1-13.

"Low Complexity Parametric Stereo Coding" (Schuijers, et al.), AES Convention Paper 6073, dated May 2004, pp. 1-11.

Heiko Purnhagen: "Low Complexity Parametric Stereo Coding in MPEG-4"; Coding Technologies; Proc. of the 7$^{th}$ Int. Conference on Digital Audio Effects (DaFx'04). Naples, Italy, Oct. 5-8, 2004.

Japanese Office Action dated Feb. 9, 2010.

* cited by examiner

FIG 9e 1100 1104 1102

| Quantizer | | | Dequ. | | |
|---|---|---|---|---|---|
| Idx | f | Idxtransm. | f | Idxreh. | Error |
| 10 | 4,5 | 2 | 4,5 | 9 | 1 |
| 9 | 4,5 | 2 | 4,5 | 9 | 0 |

ENERGY DEPENDENT QUANTIZATION FOR EFFICIENT CODING OF SPATIAL AUDIO PARAMETERS

CROSS-REFERENCE TO RELATED APPLICATIONS

This is a continuing application, under 35 U.S.C. §120, of copending International application PCT/EP2006/003284, filed Apr. 10, 2006, which designated the United States; the application also claims the priority, under 35 U.S.C. §119(e), of U.S. application No. 60/672,943, filed Apr. 19, 2005; the prior applications are herewith incorporated by reference in their entirety.

FIELD OF THE INVENTION

The present invention relates to quantization of spatial audio parameters and in particular to a concept to allow for a more efficient compression without significantly reducing the perceptual quality of an audio signal reconstructed using the quantized spatial audio parameters.

BACKGROUND OF THE INVENTION AND PRIOR ART

Recently, multi-channel audio reproduction techniques are becoming more and more important. In the view of an efficient transmission of multi-channel audio signals having 5 or more separate audio channels, several ways of compressing a stereo or multi-channel signal have been developed. Recent approaches for the parametric coding of multi-channel audio signals (parametric stereo (PS), "Binaural Cue Coding" (BCC) etc.) represent a multi-channel audio signal by means of a down-mix signal (could be monophonic or comprise several channels) and parametric side information, also referred to as "spatial cues", characterizing its perceived spatial sound stage.

A multi-channel encoding device generally receives—as input—at least two channels, and outputs one or more carrier channels and parametric data. The parametric data is derived such that, in a decoder, an approximation of the original multi-channel signal can be calculated. Normally, the carrier channel (channels) will include subband samples, spectral coefficients, time domain samples, etc., which provide a comparatively fine representation of the underlying signal, while the parametric data do not include such samples of spectral coefficients but include control parameters for controlling a certain reconstruction algorithm instead. Such a reconstruction could comprise weighting by multiplication, time shifting, frequency shifting, phase shifting, etc. Thus, the parametric data includes only a comparatively coarse representation of the signal or the associated channel.

The binaural cue coding (BCC) technique is described in a number of publications, as in "Binaural Cue Coding applied to Stereo and Multi-Channel Audio Compression", C. Faller, F. Baumgarte, AES convention paper 5574, May 2002, Munich, in the 2 ICASSP publications "Estimation of auditory spatial cues for binaural cue coding", and "Binaural cue coding: a normal and efficient representation of spatial audio", both authored by C. Faller, and F. Baumgarte, Orlando, Fla., May 2002.

In BCC encoding, a number of audio input channels are converted to a spectral representation using a DFT (Discrete Fourier Transform) based transform with overlapping windows. The resulting uniform spectrum is then divided into non-overlapping partitions. Each partition has a bandwidth proportional to the equivalent rectangular bandwidth (ERB). Then, spatial parameters called ICLD (Inter-Channel Level Difference) and ICTD (Inter-Channel Time Difference) are estimated for each partition. The ICLD parameter describes a level difference between two channels and the ICTD parameter describes the time difference (phase shift) between two signals of different channels. The level differences and the time differences are normally given for each channel with respect to a reference channel. After the derivation of these parameters, the parameters are quantized and finally encoded for transmission.

Although ICLD and ICTD parameters represent the most important sound source localization parameters, a spatial representation using these parameters can be enhanced by introducing additional parameters.

A related technique, called "parametric stereo" describes the parametric coding of a two-channel stereo signal based on a transmitted mono signal plus parameter side information. There, 3 types of spatial parameters, referred to as inter-channel intensity difference (IIDs), inter-channel phase differences (IPDs), and inter-channel coherence (IC) are introduced. The extension of the spatial parameter set with a coherence parameter (correlation parameter) enables a parametrization of the perceived spatial "diffuseness" or spatial "compactness" of the sound stage. Parametric stereo is described in more detail in: "Parametric Coding of stereo audio", J. Breebaart, S. van de Par, A. Kohlrausch, E. Schuijers (2005) Eurasip, J. Applied Signal Proc. 9, pages 1305-1322)", in "High-Quality Parametric Spatial Audio Coding at Low Bitrates", J. Breebaart, S. van de Par, A. Kohlrausch, E. Schuijers, AES 116$^{th}$ Convention, Preprint 6072, Berlin, May 2004, and in "Low Complexity Parametric Stereo Coding", E. Schuijers, J. Breebaart, H. Purnhagen, J. Engdegard, AES 116$^{th}$ Convention, Preprint 6073, Berlin, May 2004.

The international publication Wo 2004/008805 A1 teaches, how a multi-channel audio signal can be advantageously compressed by combining several parametric stereo modules, thus realizing a hierarchical structure to derive a representation of the original multi-channel audio signal comprising a down-mix signal and parametric side information.

Within the BCC and parametric stereo (PS) approach, a representation of the level differences (also called intensity differences ICLD or energy differences IID) between audio channels is a vital part of a parametric representation of a stereophonic/multi-channel audio signal. Such information and other spatial parameters are transmitted from the encoder to the decoder for each time/frequency slot. In the view of coding efficiency, it is therefore of high interest to represent these parameters as compactly as possible while preserving audio quality.

In BCC coding, the level differences are represented relative to a so-called "reference channel" and are quantized on a uniform scale in units of dB relative to a reference channel. This does not optimally exploit the fact that channels with low level with respect to the reference channel are subject to a significant masking effect when listened to by human listeners. In the extreme case of a channel having no signal at all, the bandwidth used by parameters describing this particular channel is completely wasted. In the more common case, where one channel is much fainter than another channel, that is a listener can hardly hear the faint channel during the playback, a less precise reproduction of the faint channel would also lead to the same perceptual quality of the listener, as the faint signal is mainly masked by the stronger signal.

To explain the situation and the problems arising when encoding a multi-channel signal, reference is made to FIG.

10*a* where a commonly used 5-channel signal is illustrated. The 5-channel configuration is having a left rear channel 101 (A, having a signal a(t)), a left front channel 102 (B, having a signal b(t)), a center channel 103 (C, having a signal c(t)), a right front channel 104 (D, having a signal d(t)) and a right back channel 105 (E, having a signal e(t)). Intensity relations between single channels or channel pairs are marked with arrows. Hence, the intensity distribution between the front left channel 102 and the front right channel 104 is marked $r_1$ (110), the intensity distribution between the left back channel and the right back channel is marked $r_4$ (112). The intensity distribution between the combination of the left front channel 102 and the right front channel 104 and the center channel 103 is marked $r_2$ (114) and the intensity distribution between the combination of the back channels and the combination of the front channels is marked $r_3$ (116).

When, for example, a simple monologue is recorded, most of the energy would be contained in the center channel 103. In this example, especially the back channels will contain only little (or 0) energy. Therefore, parameters describing the properties of the back channels are merely wasted in this example, since mainly the center channel 102 or the front channels will be active during the play back.

Based on FIG. 10*a*, ways of computing the energy distribution between channels or channel combinations are described within the following paragraph.

FIG. 10*a* illustrates a multi channel parameterization for a five channel speaker set-up where the different audio channels are indicated by 101 to 105; a(t) 101 represents signal of the left surround channel, b(t) 102 represents the signal of the left front channel, c(t) 103 represents the signal of the center channel, d(t) 104 represents the signal of the right front channel, e(t) 105 represents the signal of the right surround channel. The speaker set-up is divided into a front part and a back part. The energy distribution between the entire front channel set-up (102, 103 and 104) and the back channels (101 and 105) are illustrated by the arrow in FIG. 10*a* and indicated by the $r_3$ parameter. The energy distribution between the center channel 103 and the left front 102 and right front 103 channels are indicated by $r_2$. The energy distribution between the left surround channel 101 and the right surround channel 105 is illustrated by $r_4$. Finally, the energy distribution between the left front channel 102 and the right front channel 104 is given by $r_1$. Since $r_1$ to $r_4$ are parameterizations of different regions it is also clear that beside energy distribution also other essential region properties can be parameterized, as for example the correlation between the regions. Additionally for each parameter $r_1$ to $r_4$ a local energy can be calculated. For example the local energy of $r_4$ is the summed energy of channel A 101 and E 105.

$$\text{LocalEnergy}_{r4}=E[a^2(t)]+E[e^2(t)].$$

Where E[.] is the expected value as defined by $$E[f(x)] = \frac{1}{T}\int_0^T f(x(t))dt.$$

FIG. 10*b* shows a multi-channel audio decoder built by hierarchically ordering parametric stereo modules, as for example described in WO 2004/008805 A1. Here, the audio channels 101 to 105, as introduced in FIG. 10*a*, are reproduced step by step from a single monophonic down-mix signal 120 (M) and corresponding side information by a first two-channel decoder 122, a second two-channel decoder 124, a third two-channel decoder 126, and a fourth two-channel decoder 128. As can be seen, in the treelike structure in FIG. 10*b*, the first two-channel decoder decomposes the monophonic down-mix signal 120 into two signals fed into the second and the third two-channel decoders 124 and 126. Therein, the channel fed into the third two-channel decoder 126 is a combined channel, being combined from the left back channel 101 and the right back channel 105. The channel fed into the second two-channel decoder 124 is a combination of the center channel 103 and a combined channel which is again being a combination of the front left channel 102 and of the front right channel 104.

Thus, after the second step of the hierarchical decoding, the left back channel 101, the right back channel 105, the center channel 103, and a combined channel, being a combination of the front left channel 102 and the front right channel 104 are reconstructed, using the transmitted spatial parameters, that are comprising a level parameter for use by each of the two-channel decoders 122, 124, and 126.

In the third step of the hierarchical decoding, the fourth two-channel decoder 128 derives the front left channel 102 and the front right channel 104, using a level information transmitted as side information for the fourth two-channel decoder 128. Using a prior art hierarchical decoder as shown in FIG. 10*b*, the desired energy for each single output channel follows from various different parametric stereo modules between the input signal and each output signal. In other words, the energy of a specific output channel can depend on the IID/ICLD parameters of multiple parametric stereo modules. In such a treelike structure of connected parametric stereo modules, also a non-uniform quantization of IID parameters can be applied within each parametric stereo module to produce IID values, which are then used by a decoder as part of the side information. This would exploit the benefits of non-uniform IID quantization locally (i.e. within each parametric stereo module individually), nonetheless it is sub-optimum because quantization in each module ("leafs") is carried out independently of the energies/level of other audio channels that may be high in relative level and, therefore, produce masking.

This is possible, since "leaf" modules are not aware of the global level distribution at a higher tree level (e.g. the "root" module). Each leaf has its own corresponding IID/ICLD parameter, which indicates the energy distribution from its input toward output channels. For example, the IID/ICLD parameter of leaf "$r_3$" (processed by the first two-channel decoder 122) may indicate that 90% of the incoming energy should be sent to leaf $r_2$, while the remaining energy (10%) should be sent to leaf $r_4$. This process is repeated for each leaf in the tree. Since each energy distribution parameter is represented with limited accuracy, the deviation between the desired and the actual energy of each output channel A to E depends on the quantization errors in the IID/ICLD parameters, as well as on the energy distribution (and hence propagation of quantization errors). In other words, as the same quantization table is used for a certain parameter type, e.g. ICC or IID, within all parameterization stages $r_1$ to $r_4$, the IID/ICLD quantization is performed optimal only locally. This means that for each parameterization stage $r_1$ to $r_4$, the error in output energy of the (local) output channels is maximum for the weakest output channel in prior art implementations.

As detailed in the previous paragraphs, the quantization of level parameters (IID or ICLD) or other parameters such as ICC, phase differences or time differences describing the spatial perception of a multi-channel audio signal is still sub-optimal, since bandwidth may be wasted for spatial parameters describing channels that are mainly masked due to low energy within the channel.

SUMMARY OF THE INVENTION

It is the object of the present invention to provide an improved concept for quantization of spatial parameters of a multi-channel audio signal.

According to a first aspect of the present invention this object is achieved by a parameter quantizer for quantizing an input parameter, wherein the input parameter is a measure for a characteristic of a single channel or a pair of channels with respect to another single channel or a pair of channels of a multi-channel signal, comprising: a quantization rule generator for generating a quantization rule based on a relation of an energy measure of the channel or the pair of channels and an energy measure of the multi-channel signal; and a value quantizer for deriving a quantized parameter from the input parameter, using the generated quantization rule.

According to a second aspect of the present invention this object is achieved by a parameter dequantizer for dequantizing a quantized parameter to derive a parameter, wherein the parameter is a measure for a characteristic of a single channel or a pair of channels with respect to another single channel or a pair of channels of a multi-channel signal, comprising: a dequantization rule generator for generating a dequantization rule based on a relation of an energy measure of the channel or the pair of channels and an energy measure of the multi-channel signal; and a value dequantizer for deriving the parameter from the quantized parameter, using the generated dequantization rule.

According to a third aspect of the present invention this object is achieved by a method of quantizing an input parameter, wherein the input parameter is a measure for a characteristic of a single channel or a pair of channels with respect to another single channel or a pair of channels of a multi-channel signal, the method comprising: generating a quantization rule based on a relation of an energy measure of the channel or the pair of channels and an energy measure of the multi-channel signal; and deriving a quantized parameter from the input parameter using the generated quantization rule.

According to a fourth aspect of the present invention this object is achieved by a method of dequantizing a quantized parameter to derive a parameter, wherein the parameter is a measure for a characteristic of a single channel or a pair of channels with respect to another single channel or a pair of channels of a multi-channel signal, the method comprising: generating a dequantization rule based on a relation of an energy measure of the channel or the pair of channels and an energy measure of the multi-channel signal; and deriving the parameter from the quantized parameter using the generated dequantization rule.

According to a fifth aspect of the present invention this object is achieved by a representation of a multi-channel signal having a quantized parameter being a quantized representation of a parameter being a measure for a characteristic of a single channel or a pair of channels, wherein the parameter is a measure for a characteristic of the single channel or the pair of channels with respect to another single channel or a pair of channels of a multi-channel signal, wherein the quantized parameter is derived using a quantization rule based on a relation of an energy measure of the channel or the pair of channels and an energy measure of the multi-channel signal.

According to a sixth aspect of the present invention this object is achieved by a machine-readable storage medium having stored thereon a representation of a multi-channel signal as described above.

According to a seventh aspect of the present invention this object is achieved by a transmitter or audio recorder having a parameter quantizer for quantizing an input parameter, wherein the input parameter is a measure for a characteristic of a single channel or a pair of channels with respect to another single channel or a pair of channels of a multi-channel signal, comprising: a quantization rule generator for generating a quantization rule based on a relation of an energy measure of the channel or the pair of channels and an energy measure of the multi-channel signal; and a value quantizer for deriving a quantized parameter from the input parameter, using the generated quantization rule.

According to an eighth aspect of the present invention this object is achieved by a receiver or audio player having a parameter dequantizer for dequantizing a quantized parameter to derive a parameter, wherein the parameter is a measure for a characteristic of a single channel or a pair of channels with respect to another single channel or a pair of channels of a multi-channel signal, comprising: a dequantization rule generator for generating a dequantization rule based on a relation of an energy measure of the channel or the pair of channels and an energy measure of the multi-channel signal; and a value dequantizer for deriving the parameter from the quantized parameter, using the generated dequantization rule.

According to a ninth aspect of the present invention this object is achieved by a method of transmitting or audio recording, the method comprising a method of quantizing an input parameter, wherein the input parameter is a measure for a characteristic of a single channel or a pair of channels with respect to another single channel or a pair of channels of a multi-channel signal, the method comprising: generating a quantization rule based on a relation of an energy measure of the channel or the pair of channels and an energy measure of the multi-channel signal; and deriving a quantized parameter from the input parameter using the generated quantization rule.

According to a tenth aspect of the present invention this object is achieved by a method of receiving or audio playing, the method having a method of dequantizing a quantized parameter to derive a parameter, wherein the parameter is a measure for a characteristic of a single channel or a pair of channels with respect to another single channel or a pair of channels of a multi-channel signal, the method comprising: generating a dequantization rule based on a relation of an energy measure of the channel or the pair of channels and an energy measure of the multi-channel signal; and deriving the parameter from the quantized parameter using the generated dequantization rule.

According to an eleventh aspect of the present invention this object is achieved by a transmission system having a transmitter and a receiver, the transmitter having a parameter quantizer for quantizing an input parameter; and the receiver having a parameter dequantizer for dequantizing a quantized parameter.

According to a twelfth aspect of the present invention this object is achieved by a method of transmitting and receiving, the method including a transmitting method having a method of quantizing an input parameter; and the method including a method of receiving including a method of dequantizing a quantized.

According to a thirteenth aspect of the present invention this object is achieved by a computer program for performing, when running on a computer, one of the above methods.

The present invention is based on the finding that parameters being a measure for a characteristic of a single channel or of a pair of channels with respect to another single channel or of a pair of channels of a multi-channel signal can be quantized more efficiently using a quantization rule that is generated based on a relation of an energy measure of the channel or the pair of channels and an energy measure of the multi-channel signal.

The inventive concept has the major advantage that a quantization rule is either generated or an appropriate quantization rule is selected from a group of available quantization rules, depending on the energy of the signal to be described. Therefore, a psycho-acoustic model can be applied to a quantizer during encoding or a dequantizer during decoding, to use a quantization rule adapted to the needs of the actual signal. Especially, when a channel contains very little energy compared to other channels within the multi-channel signal, the quantization can be much more coarse than for signals having high energies. This is due to the fact that the high energy signals mask the low energy signals during playback, i.e. a listener will hardly recognize any details of the low energy signal and thus the low energy signal can be deteriorated more through coarse quantization without the listener being able to recognize the falsification because of the high masking of the low energy signal.

In one embodiment of the present invention, a parameter quantizer for quantizing parameters is having a quantization rule generator for generating a quantization rule and a value quantizer for deriving quantized parameters from input parameters using the generated quantization rule. To generate an appropriate quantization rule, the quantizer selector receives as an input the total energy of the multi-channel audio signal to be coded and the local energy of the channel or the pair of channels whose spatial parameters are to be quantized. Knowing the total energy and the local energy, the quantizer selector can decide, which quantization rule to use, i.e. select coarser quantization rules for channels or channel pairs having comparatively low local energy. Alternatively, the quantizer selector could also derive an algorithmic rule to modify an existing quantization rule or to calculate a completely new quantization rule depending on the local and the total energy. One possibility would for example be to calculate a general scale factor to be applied to a signal before a linear quantizer or a non-linear quantizer to achieve the goal of reducing the size of the side information to be transmitted.

In a further embodiment of the present invention a multi channel signal is encoded in a pairwise manner, i.e. by using a hierarchical structure that is having several 2-to-1 downmixers ordered in a tree-like structure, each downmixer generating a mono channel out of two channels input into the downmixer. Following the inventive concept, energy dependent quantization can now be implemented not only locally, i.e. at each 2-to-1 downmixer having the information available at the input of the 2-to-1 downmixer only, but based on the global knowledge on the sum of the signal energies. This enhances the perceptual quality of a perceptual signal significantly.

It is evident that following the inventive concept, the side information size can be decreased while the quality of the encoded multi-channel audio signal is hardly affected.

In a further embodiment of the present invention, an inventive parameter quantizer is incorporated in a parameter encoder before a differential encoder and a Huffman encoder, both of which are used for further encoding the quantized parameters to derive a parameter bit stream. Such an inventive encoder has the great advantage that in addition to decreasing the size of code words needed to describe the quantized parameters, a coarser quantization will automatically increase the abundance of identical code words fed into the differential encoder and the Huffman encoder, which allows for a better compression of the quantized parameters, further reducing the size of the side information.

In a further embodiment of the present invention, an inventive parameter quantizer is having a quantizer factor function generator and a parameter multiplier. The quantizer factor function generator receives the total and the local energy as input and derives a single scaler value from the input quantities. The parameter multiplier receives the parameters and the derived quantizer factor f to divide the parameters by the quantizer factor prior to transferring the modified parameters to the quantizer that applies a fixed quantization rule to the modified parameters.

A variation of this embodiment is to have a parameter multiplier after the quantizer and hence use the derived quantizer factor f to divide the resulting index out of the quantizer. The result of this then needs to be rounded into an integer index again.

Application of a scaling factor to the parameters has the same effect as choosing different quantization rules, since for example division by a big factor compresses the input parameter space such that effectively only a smaller part of a already existing quantization rule would be effective. This solution has the advantage that on the decoder and the encoder side additional memory can be saved because there is only one quantization rule to be stored or to be processed since the scaling is done by a simple multiplication requiring only limited additional hard- or software. An additional advantage is that by applying a quantizer factor, the quantizer factor can be derived using any possible functional dependence. Therefore, a quantizer or dequantizer sensitivity can be adjusted continuously within the whole possible input parameter space rather than selecting predefined quantization rules out of a given sample.

BRIEF DESCRIPTION OF THE DRAWINGS

Preferred embodiments of the present invention are subsequently described by referring to the enclosed drawings, wherein:

FIG. 9*e* shows examples of quantization and dequantization of parameters;

DETAILED DESCRIPTION OF PREFERRED EMBODIMENTS

Figure 1:
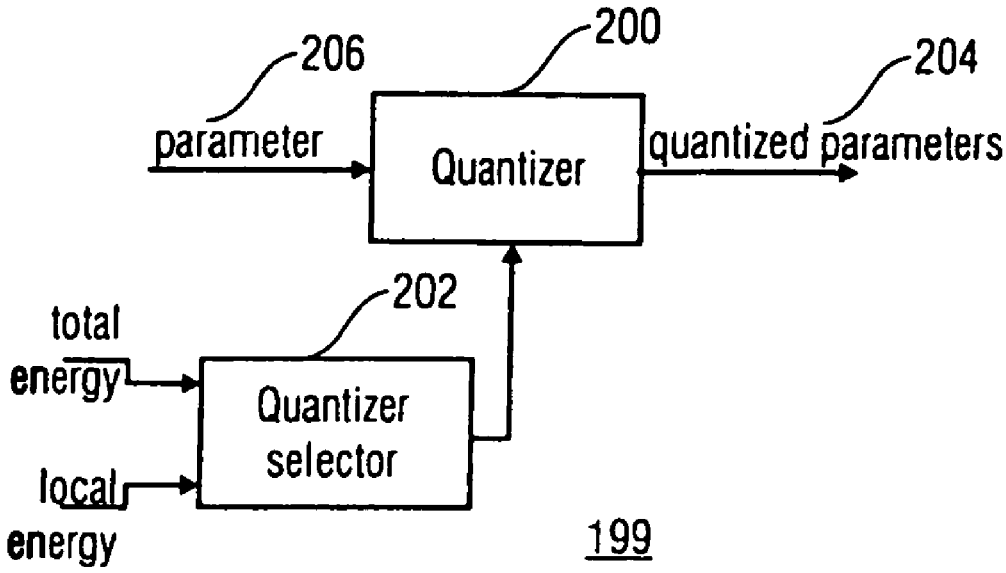
FIG. 1 shows a block diagram of an inventive parameter quantizer.

FIG. 1 shows an inventive parameter quantizer 199 having a quantizer 200 and a quantizer selector 202. The quantizer selector 202 receives the local energy of the channel or the pair of channels underlying the parameters to be encoded and the total energy of the multi-channel audio signal. Based on both energy informations, the quantizer selector 202 generates a quantization rule that is used by the quantizer 200 to derive a quantized parameter 204 from a parameter 206 input into the quantizer 200. Hence, in this case the quantizer selector 202 serves as a quantization rule generator.

The input parameters to the quantizer selector 202 are the total energy of the original multi-channel signal and the local energy for the channel described by the parameter to be quantized. In a preferred embodiment of the present invention the ratio between the local energy and the total energy gives a measure that can be used to decide which quantizer to use. As an example this ratio q (Relative Local energy) can be calculated in dB, using the following equation:

$$q = 10 \cdot \log10\left(\frac{LocalEnergy}{TotalEnergy}\right)$$

The selected quantizer is then used to quantize the parameter 206 with the quantizer.

Figure 10A:
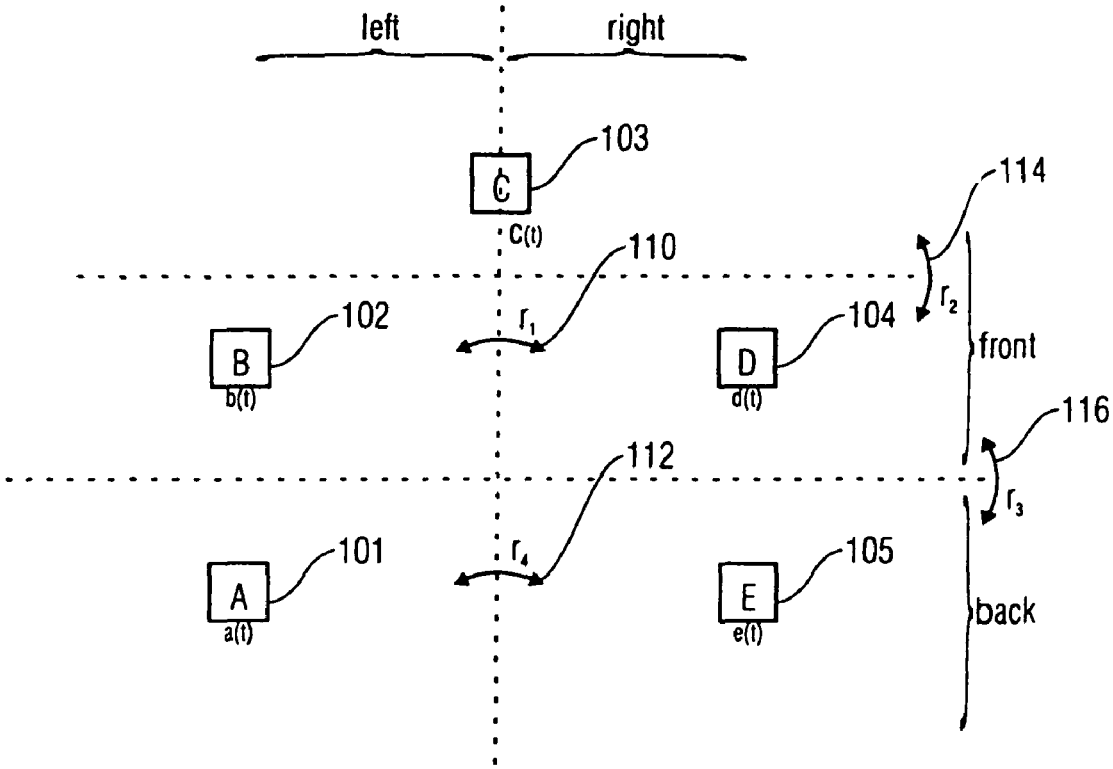
FIG. 10*a* shows a representation of a 5-channel multichannel audio signal.

The present invention teaches that a coarser quantization of IID/ICLD parameters (and the like) can be used if a parametrization stage is lower in energy compared to the total energy, i.e. when the relative Local energy q is small. The present invention utilizes the psycho-acoustic relation that it is more important to parameterize the dominant/high energy signals with high accuracy than the audio signal with less significance/low energy. To make this even clearer, reference is again made to FIG. 10*a*. When within an audio scene in the original multi-channel signal the energy/signal is primarily present in the front image, meaning the left front channel 102, the center channel 103 and the right front channel 104, the surround channels can be quantized with less accuracy since the surround channels have much less energy. The additional quantization error introduced from the coarser quantization cannot be perceived since the front channels have much higher energy and hence the quantization error of $r_4$ (and the resulting energy errors for surround channels A and E) is masked by channels B, D, and/or C.

In the most extreme example, the surround channels A and E only have some faint noise and the front channels B, C, and D have full amplitude signals. In such a case, a 16 bit PCM original signal would indicate an energy difference of more than 80 dB. Therefore, parameter $r_4$ could be quantized arbitrarily coarse without introducing any audible differences due to (coarse) quantization.

Figure 2A:
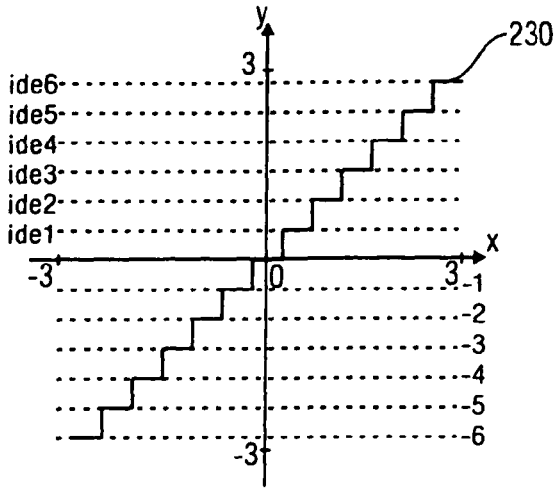
FIGS. 2*a* to *c* show several possible quantization rules to be applied.
Figure 2B:
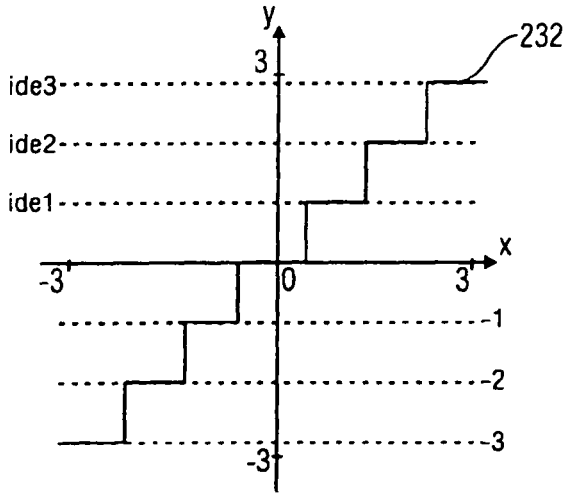
Figure 2C:
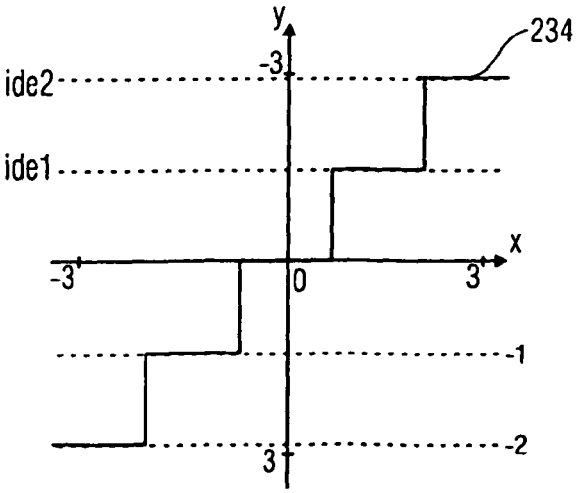

FIGS. 2*a* to 2*c* show three possible quantization rules introducing different levels of quantization errors. All figures show the original parameter on their x-axis and the integer values assigned to the parameters on their y-axis. Furthermore the FIGS. 2*a* to 2*c* show dashed lines which correspond to indices for each quantization step and hence can be used for transmission or storage. The transmitted indices can then be used on the decoder side, for example in combination with a lookup-table, for de-quantization.

The finest quantization is indicated in FIG. 2*a* by the quantization curve 230 that maps discrete parameter intervals of the x-axis to 13 integer values. Intermediate quantization is achieved by the quantization curve 232 in FIG. 2*b*, whereas the coarsest quantization is achieved by the quantization curve 234 of FIG. 2*c*. It is obvious that the quantization error introduced is biggest in the example shown in FIG. 2*c* and smallest in the example shown in FIG. 2*a*.

These three quantization rules are examples of quantization rules that may be selected by the quantizer selector 202. In other words, FIGS. 2*a* to *c* illustrate three different linear quantization rules, where the x-axis describes the input value and the y-axis gives the corresponding quantized value. FIGS. 2*a* to 2*c* all have the same scale on the x-axis and y-axis and hence, FIG. 2*a* has the finest quantization of the three and thus the smallest quantization error. FIG. 2*c* has the coarsest quantization and thus the largest quantization error. It would also yield the lowest bit rate after differential coding and Huffman coding since it has the smallest amount of quantization steps.

As an example, a possible quantization rule generation could be based on the relative Local energy q between the local energy and the total energy, as introduced above. A possible range of q-values with corresponding selections of quantization rules is summarized, as an example, within the following table:

| Value of q [dB] | Selected Quantizer |
|---|---|
| 0 <= q < −10 | Fine quantization FIG. 2A |
| −10 <= q < −20 | Medium quantization FIG. 2B |
| −20 <= q | Coarse quantization FIG. 2C |

Figure 3:
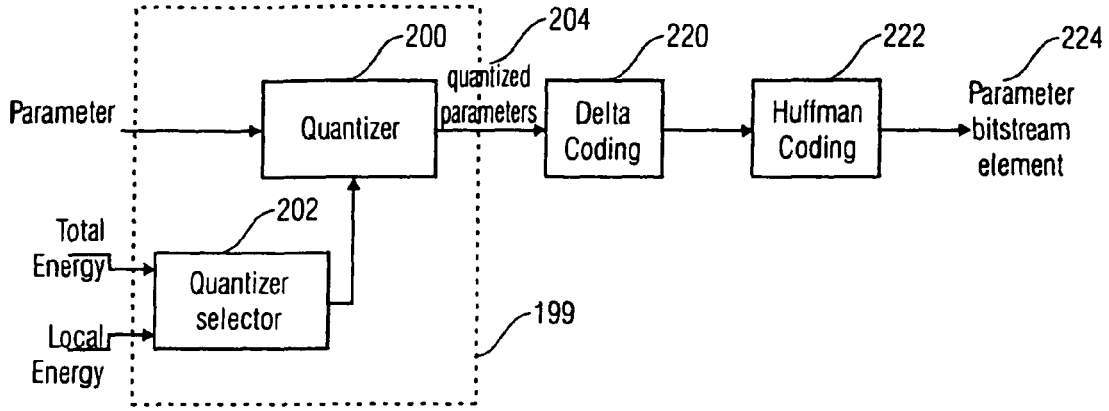
FIG. 3 shows a parameter encoder having an inventive parameter quantizer.

FIG. 3 shows an inventive parameter compressor having an inventive parameter quantizer 199, a differential encoder 220, and a Huffman encoder 222. The inventive parameter encoder of FIG. 3 extends the parameter quantizer of FIG. 1 by using the quantized parameters as input for the differential encoder 220 that differentially encodes the quantized parameters 204 to derive differentially encoded quantized parameters that are then input into the Huffman encoder 222 that applies a Huffman coding scheme to the differentially encoded quantized parameters deriving a parameter bitstream element 224 of a final parameter bit stream as output.

The combination of an inventive parameter quantizer with a differential encoder and a Huffman encoder is particularly attractive since coarser quantization results in a higher abundance of equal symbols (quantized parameters). The combination of the differential encoder 220 and the Huffman encoder 222 will evidently provide an encoded representation of the quantized parameters (parameter bitstream element 224) that is more compact, when the maximum number of possible input symbols is decreased by a coarser quantization.

Figure 4A:
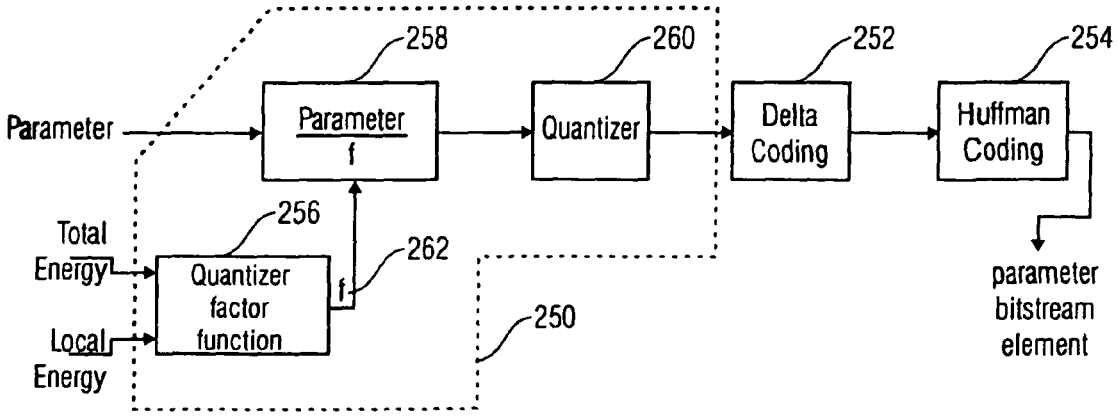
FIGS. 4*a*, 4*b* show an alternative embodiment of a parameter encoder having an inventive parameter quantizer.

FIG. 4*a* shows a further embodiment of an inventive parameter encoder using an inventive parameter quantizer 250, a differential encoder 252, and a Huffman encoder 254.

The parameter quantizer 250 is having a quantizer factor generator 256, a parameter scaler 258, and a quantizer 260. In this case the quantizer factor generator 256 together with the parameter scaler 258 serve as a quantization rule generator.

The quantizer function generator 256 receives as input the total energy of the multi-channel audio signal and the local energy of the channel or the channel pair for the parameter to be quantized. The quantizer factor generator 256 generates a scale factor 262 (f) based on the local energy and the total energy. In a preferred embodiment this is done on a basis of a ratio between the local energy and the total energy resulting in a relative local energy q, as follows:

$$q = 10 \cdot \log10\left(\frac{LocalEnergy}{TotalEnergy}\right).$$

This ratio q can be used within the quantizer factor generator 256 to calculate the quantizer factor f (262) that is used as input for the parameter scaler 258 that additionally receives the parameter to be quantized.

The parameter scaler 258 applies a scaling to the input parameter that could for example be a division of the parameter by the quantizer factor 262. The scaling of the parameter is equivalent to selecting different quantization rules. The scaled parameter is then input into a quantizer 260 that applies a fixed quantization rule within this embodiment of the present invention. The further processing of the quantized parameter is equal to the processing of FIG. 3, the parameter is differentially encoded and afterwards Huffman encoded to finally yield a parameter bit stream element.

Applying a scaling factor to the parameters has the advantage that the quantization rule could be adapted to the needs in a continuous way, since an analytical function deriving the quantization factor 262 can basically have any form.

Figure 4B:
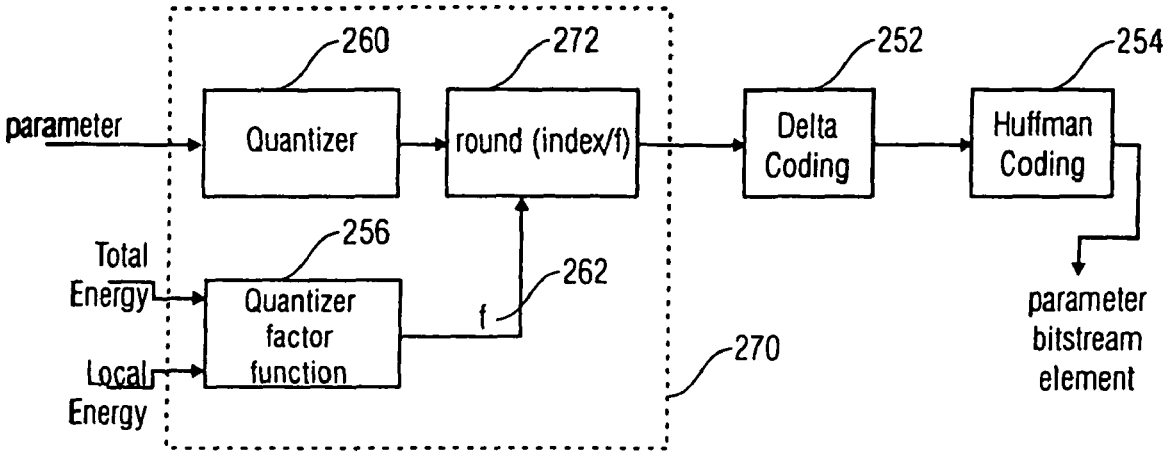

FIG. 4*b* shows a further embodiment of an inventive parameter encoder 270 which is similar to the inventive parameter encoder 250 shown in FIG. 4*a*. Therefore, only the differences to parameter encoder 250 shall be explained shortly within the following paragraph.

The inventive parameter encoder 270 is not having a parameter scaler (parameter scaler 258 of parameter encoder 250). To achieve an energy dependency of quantization, the parameter quantizer 270 is having a compression device 272 instead. That means the quantizer factor generator 256 together with the compression device 258 serve as a quantization rule generator in this case. The compression device 272 is connected to the quantizer 260 and to the quantizer factor generator 256. The compression unit 272 receives as an input a quantized parameter that is quantized by the quantizer 260 according using a fixed quantization scheme. To implement the energy dependence, the compression unit uses the quantized parameter as input and scales the quantized parameter using the scale factor 262. This saves bit rate by decreasing the possible number of quantized parameters to be transmitted to the delta coder 252. This compression can for example be achieved by a division of the quantized parameter index by the scaling factor 262.

Figure 5:
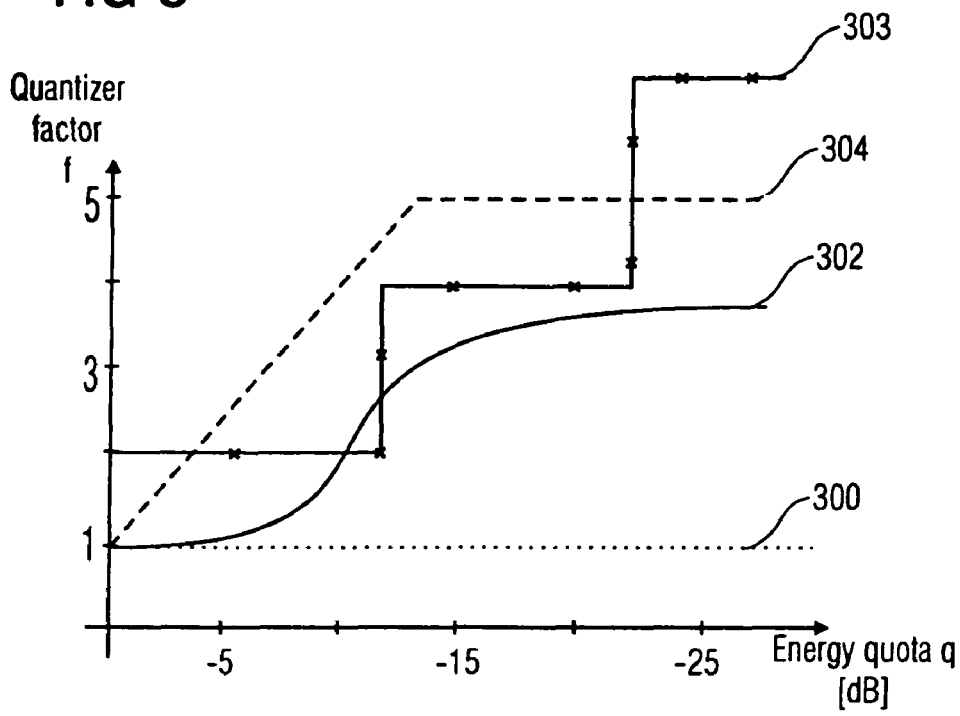
FIG. 5 shows examples of scale factor functions.

Possible functions to derive the scale factor 262 from the relative Local energy ratio q are shown in FIG. 5. FIG. 5 shows as an example four different possible functions 300, 302, 303, and 304 that can be used to derive the scale factor f. The first factor function 300 is a constant function and thus has no energy dependency.

The factor functions 302, and 304 show two possibilities to implement factor functions, wherein the factor function 302 is the less aggressive one and would therefore increase the introduced quantization error less than using factor function 304. On the other hand, factor function 302 would save less bit rate than factor function 304. Factor function 303 shows a fourth possibility to derive the quantizer factor from the energy quota q, whereas the factor function 303 is step-like in form and therefore assigns intervals of the energy quota q to the same quantizer factor.

Figure 6:
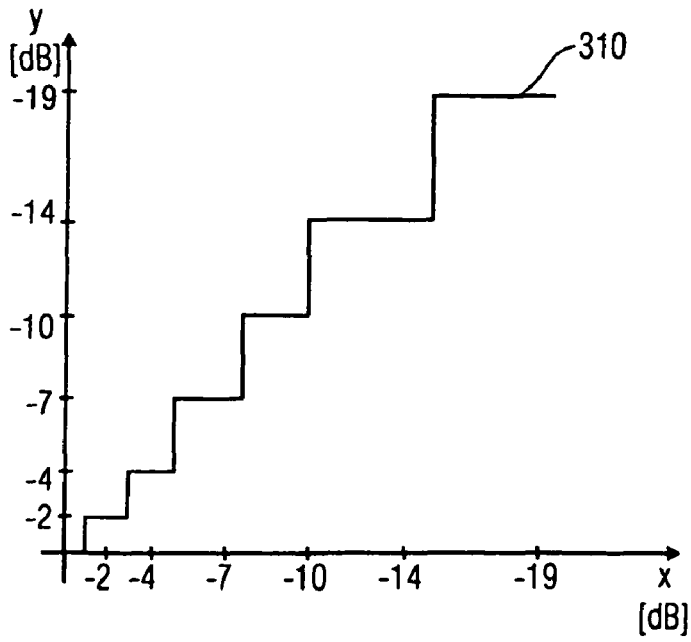
FIG. 6 shows a non-linear quantization rule.

FIG. 6 exemplifies a non-uniform quantizer where the input on the x-axis in dB is quantized according to the function 310 to result in the output y in dB that is drawn on the y-axis. Such a non-uniform quantizer function can be used to quantize spatial parameters as well. This is of special interest when the reference channel within a BCC-coding scheme is chosen to be the strongest channel within a multi-channel signal. The non-uniform quantizer as shown in FIG. 6 exemplifies a quantizer function 310 that would suit the needs then, since the quantization steps increase as the energy level becomes smaller compared to the referenced channel. This is a particularly attractive property since the energy level quantizing errors can be larger for channels with less energy than for the strongest channels.

Figure 7:
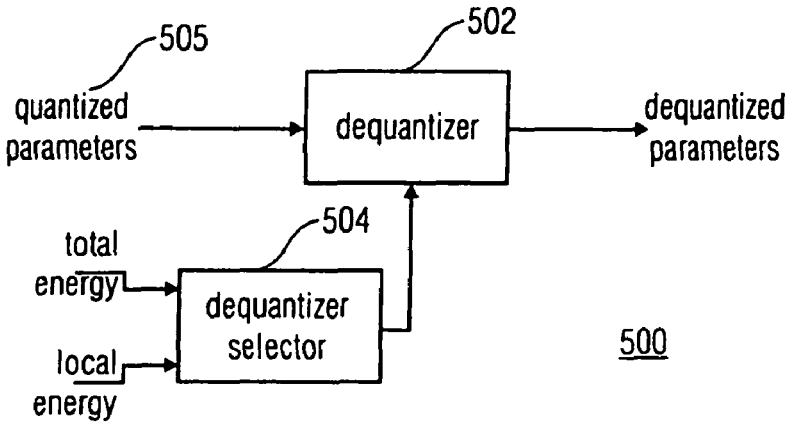
FIG. 7 shows an inventive parameter dequantizer.

FIG. 7 shows an inventive parameter dequantizer 500 having a dequantizer 502 and a dequantizer selector 504. The dequantizer selector 504 receives the total energy of the multi-channel audio signal and the local energy of the channel or channel pairs together with a quantized parameter 505 that is to be dequantized. Based on the received energy information, the dequantizer selector 504 derives a dequantization rule that is used by the dequantizer 502 to dequantize the quantized parameter 505. Hence, in this case the dequantizer selector 504 serves as a dequantization rule generator.

It may be noted that the dequantizer selector 504 may operate in different ways. A first possibility is that the dequantizer selector 504 derives the quantization rule directly and transfers the derived quantization rule to the dequantizer 502. Another possibility is that the dequantizer selector 504 meets a dequantization rule decision, which is transferred to the dequantizer 502 that can use the dequantization rule decision to select the appropriate dequantization rule from a number of quantization rules that are for example stored in the dequantizer 502.

Figure 8:
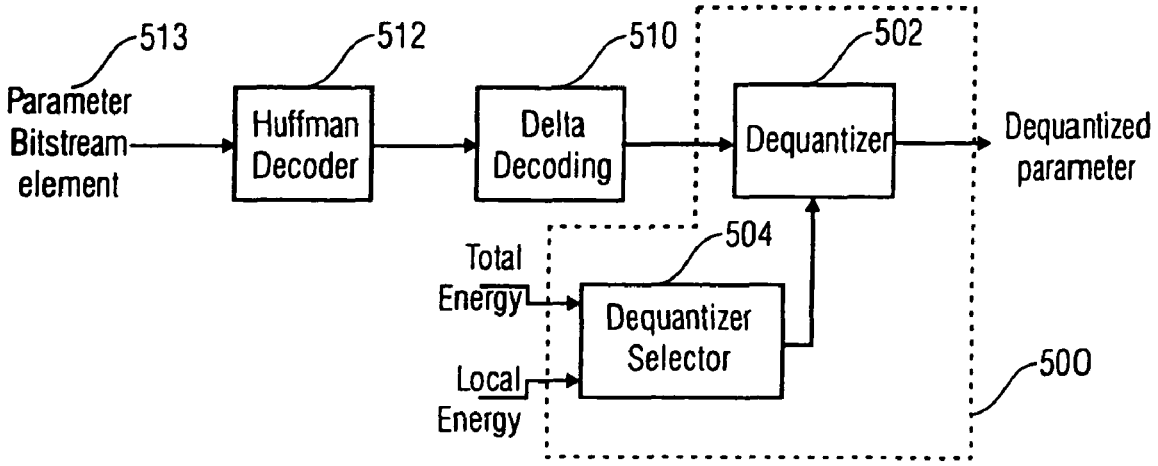
FIG. 8 shows a parameter decompressor having an inventive parameter dequantizer.

FIG. 8 shows an inventive parameter decoder having a parameter dequantizer 500, a differential decoder 510, and a Huffman decoder 512.

The Huffman decoder 512 receives a parameter bit stream element 513 and in association therewith, the dequantizer selector 504 receives the local energy of a channel or a pair of channels described by the parameter bit stream element 513 and the total energy of the multi-channel audio signal. The parameter bit stream element 513 is produced by an inventive parameter encoder, as shown in FIG. 3. Therefore, the parameter bit stream element 513 is Huffman decoded by the Huffman decoder 512 and differentially decoded by a differential decoder 510 before being supplied to the dequantizer 502. After the decoding by the Huffman decoder 512 and the differential decoder 510, the dequantization is performed by the inventive parameter dequantizer 500, as already described in the description of the inventive parameter of FIG. 7.

In other words, FIG. 8 illustrates a decoder using an energy dependent dequantizer 500, the decoder corresponding to an inventive encoder. The parameter bit stream element is Huffman decoded and differentially decoded into indices. The correct dequantizer is chosen in the dequantizer selector 504 using the same rule and function as was used in the encoder with the total energy and local energy as input. The selected dequantizer is then used to dequantize (using the dequantizer 502) the indices into dequantized parameters.

Figure 9A:
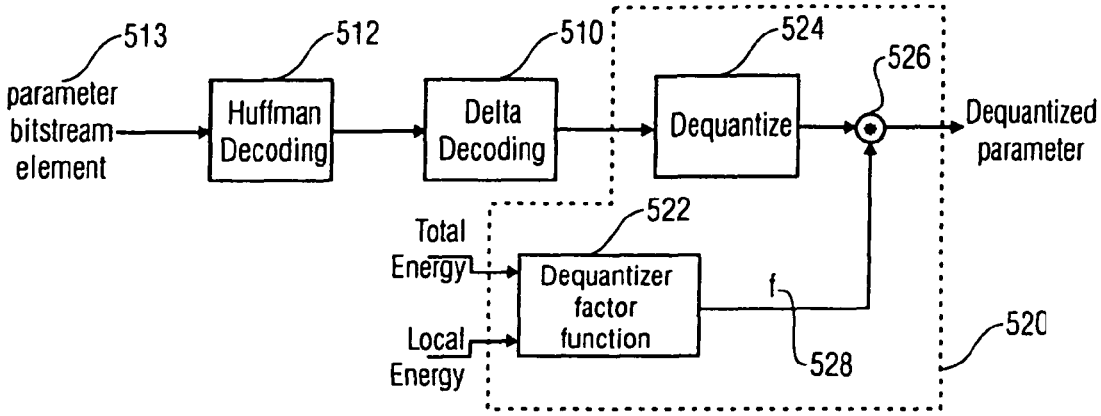
FIG. 9*a* shows an embodiment of an inventive parameter dequantizer.

FIG. 9*a* shows a further embodiment of an inventive parameter decoder, having an inventive energy dependent dequantizer 520, a Huffman decoder 512, and a differential decoder 510. The parameter dequantizer 520 comprises a quantizer factor generator 522, a dequantizer 524, and a parameter scaler 526. In this case the dequantizer factor generator 522 together with the parameter scaler 526 serve as a dequantization rule generator.

After decoding the parameter bit stream element 513 by the Huffman decoder and the differential decoder, the quantized parameter is dequantized by the dequantizer 524, wherein the dequantizer 524 is using a dequantization rule matching a quantization rule used to generate the quantized parameter. The quantizer factor generator 522 derives a scale factor 528 (f) from a ratio of the local energy and the total energy of the multi-channel audio signal. The parameter scaler 526 then applies the scale factor 528 to the dequantized parameter by a multiplication of the scale factor with the dequantized parameter.

After the scaling by the parameter scaler 526, the decompressed dequantized parameters are available at an output of the inventive parameter decoder.

Figure 9B:
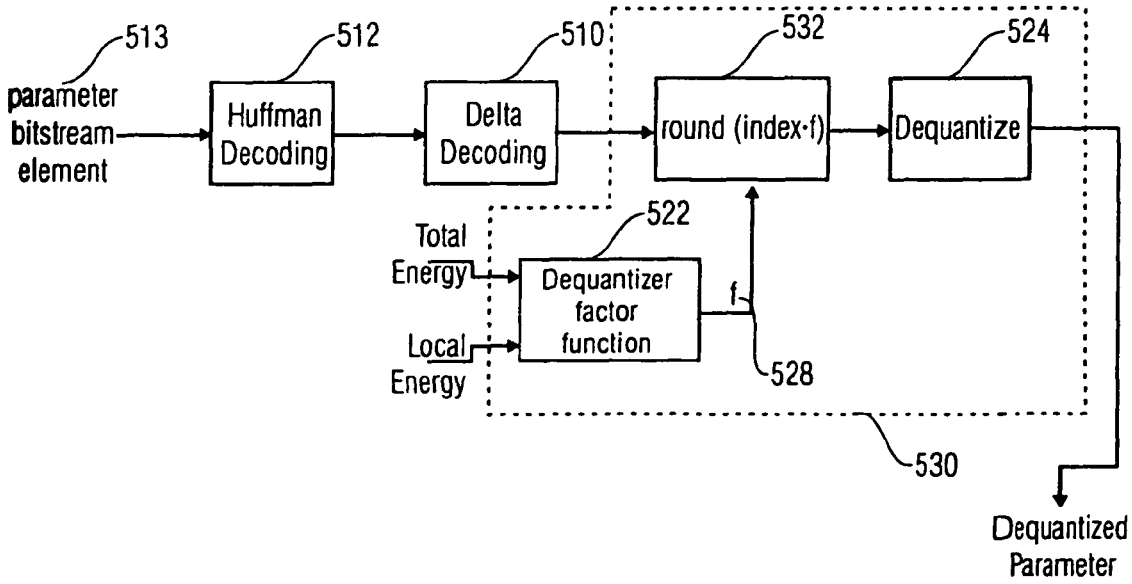
FIG. 9*b* shows a further embodiment of an inventive parameter dequantizer.

FIG. 9*b* shows a further embodiment of an inventive parameter decoder 530, similar to the inventive parameter decoder 520. Therefore, only the differences to the parameter decoder 520 shall be elaborated on in the following paragraph.

The inventive parameter decoder 530 is having a decompressor 532, the decompressor 532 achieving the same functional result as the parameter scaler 526 in the inventive parameter decoder 520. The decompressor 532 receives as an input the quantized parameters and as further input the scale factor 528 from the factor generator 522. That means the factor generator 522 together with the decompressor 532 serve as a dequantization rule generator in this case. To implement the energy weighted dequantizing functionality, the quantized parameter is scaled by the decompressor 532 before the so derived scaled quantized parameter is input into the dequantizer 524. The dequantizer 524 then dequantizes the scaled quantized parameter to derive the dequantized parameter using a fixed dequantization rule. This decompression can for example be achieved by a multiplication of the quantized parameter index by the scale factor 528.

Although the scaling by the parameter scaler 258 and the parameter scaler 526 during the encoding and decoding is described to be a division during the encoding and a multiplication during the decoding, any other type of scaling that has the same effect as using a different quantization rule can be applied to the parameters during the encoding or decoding.

Figure 10B:
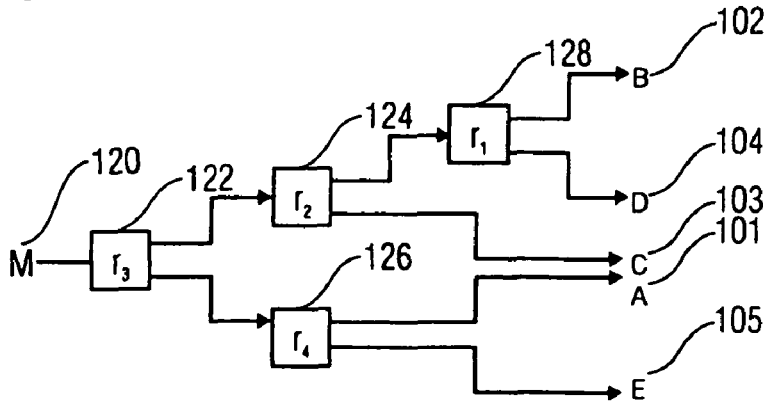
FIG. 10*b* shows a hierarchical parametric multi-channel decoder according to prior art.

In the case of a stacked parameterization (hierarchical de- or encoding) as exemplified for example in FIG. 10*b*, it should be noted that since the decoder can decode the energy distribution from the roots (the down-mix channel) out to the leafs, there is a well-defined local energy in each parametrization $r_1$ to $r_4$ (two channel decoders 122, 124, 126, and 128), which can be used as the local energy on the decoder side. Additionally, if an encoder also quantizes from root to leaf, exactly the same local energy can be used on the encoder as local energy for the quantizer selector and the quantizer factor function.

In other words, a decoder may either decide autonomously which dequantization rule to use using the total energy and the local energy. Alternatively, it could be signalled by some additional side information to the decoder, which dequantization rule is the appropriate one to dequantize the parameters.

Although described within different embodiments of the present invention, the application of a scale factor and the selection of an appropriate dequantization rule can also be combined within one embodiment of an inventive encoder or decoder.

Figure 9C:
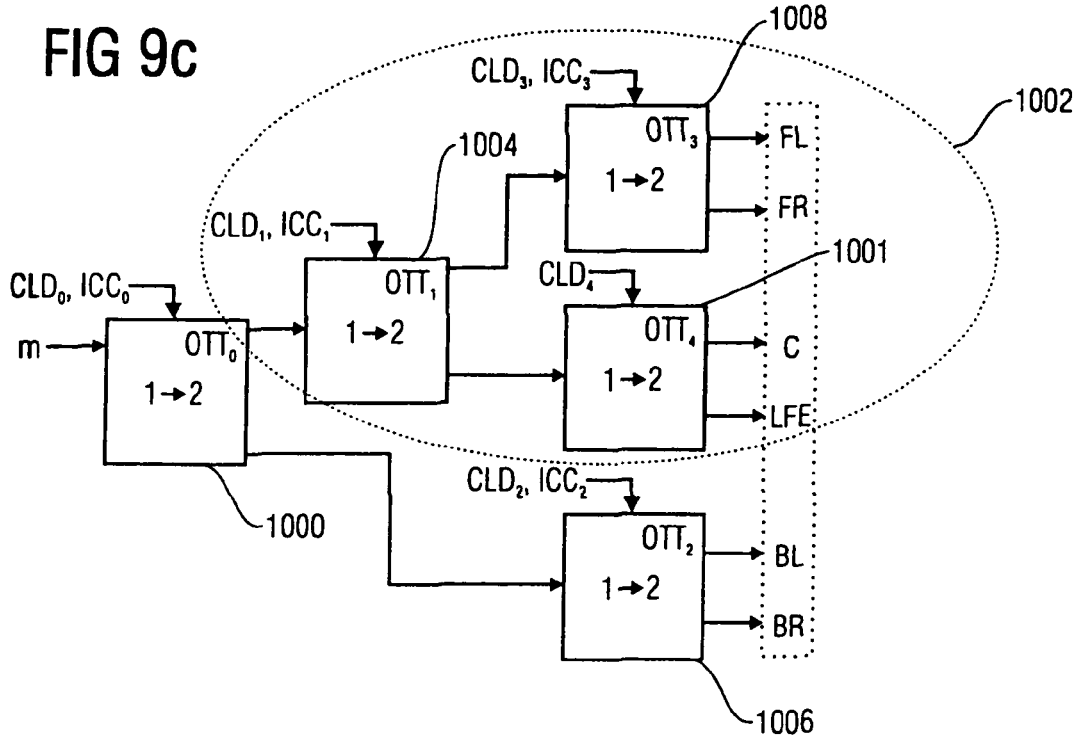
FIG. 9*c* shows an example for implementing energy dependent dequantization.
Figure 9D:
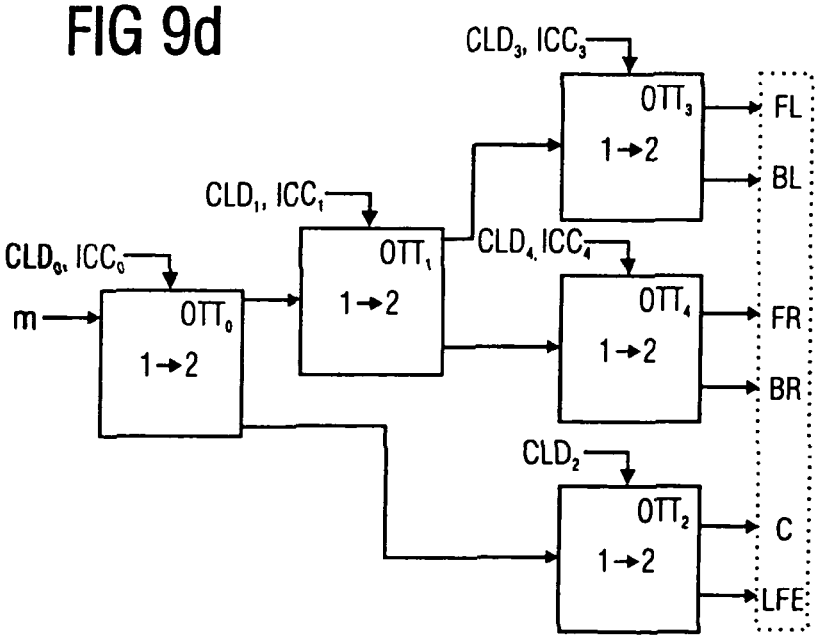
FIG. 9*d* shows a further example for implementing energy dependent dequantization.

To give a more detailed example, two possible ways of implementing energy dependent dequantization for the reconstruction of a multi-channel signal from a transferred monophonic signal M using additionally transmitted spatial parameters (CLD, ICC) are shown in FIGS. 9*c* and 9*d*. Before discussing the Figs., it may be noted that the tree-like structure shown in the Figs. is only important for the reconstruction of the spatial parameters, wherein the actual ab-mix for generation of the individual channels of a multi-channel signal is normally performed within a single step.

FIG. 9*c* shows the situation where the parameters CLD are derived such that it is assumed that a parameter $CLD^0$ describes the energy distribution between channels that are combined using a number of channels of the original signal.

In the first hierarchic up-mix position 1000, $CLD^0$ describes the energy relation between two channels, wherein a first channel is a combination 1002 of a front-left, a front-right, a center and a low-frequency-enhancement channel. The second channel is a combination of a back-left and a back-right channel. In other words, the parameter $CLD^0$ describes the energy distribution between all rear channels and all front channels.

It is therefore evident when $CLD^0$ indicates that only little energies contained in the rear channels, the parameters describing the spatial properties between the back-left and the back-right channel may be quantized stronger, since the additionally-introduced distortion by the coarse quantization is hardly audible when all channels are played back simultaneously.

An inventive parameter dequantizer, as shown in FIG. 9*b* is, for example, calculating a scale factor 528 to implement the dequantization by multiplying a parameter to be dequantized with a parameter index before the actual dequantization is performed. Therefore, if a parameter $CLD^0$ is transmitted, one may, when using the decoder of FIG. 9*b* for example, calculate the finally-used CLD parameters of other hierarchical steps according to the following formula.

In the following, the term "DEQ" describes the application of a fixed dequantization table to a parameter given to the procedure DEQ. That means, a transmitted parameter IDX CLD (0,L) can be dequantized directly, indicated by the following expression:

$$D_{CLD}^{Q}(0,l,m)=deq(idxCLD(0,l,m),CLD)$$

Since the CLD parameter describes an energy distribution between two channels and the channels are combinations of channels as indicated in FIG. 9*c*, one may now derive the relative local energy FC according to:

$$RelativeLocalEnergyFC_{5151}(l,m)=10\cdot\log10\left(\frac{10^{\left(\frac{D_{CLD}^{Q}(0,l,m)}{10}\right)}}{1+10^{\left(\frac{D_{CLD}^{Q}(0,l,m)}{10}\right)}}\right)$$

The relative local energy of the back channels is accordingly:

$$RelativeLocalEnergyS_{5151}(l,m)=10\cdot\log10\left(\frac{1}{1+10^{\left(\frac{D_{CLD}^{Q}(0,l,m)}{10}\right)}}\right)$$

Given the above and the inventive concept, $CLD^1$ can now be computed, taking into account the overall energy contained in the combination signal 1002:

$$idxCLDEdQ(1,l,m)=\max(-15,\min(15,\mathrm{round}(idxCLD(1,l,m)\cdot facFunc(\mathrm{RelativeLocalEnergy}FC_{5151}(l,m)))))$$

In the formula given above, the term "facFunc" describes a function giving a real value independency of the relative local energy FC. In other words, formula 4 describes that before dequantization, the transmitted parameter index IDX CLD (1,l,m) is multiplied with a scale factor (facFunc) to derive an intermediate quantized parameter. Since the intermediate quantized parameter is not necessarily integer-valued, the intermediate quantized parameter must be rounded to derive IdxCLDEdQ, which is then dequantized into the final parameter used by the following operation:

$$D_{CLD}^{Q}(1,l,m)=deq(idxCLDEdQ(1,l,m),CLD)$$

Dequantization is performed by a standard dequantization table, such as, for example, the following:

| | Idx | | | | | | | | | | |
|---|---|---|---|---|---|---|---|---|---|---|---|
| | −15 | −14 | −13 | −12 | −11 | −10 | −9 | −8 | −7 | −6 | −5 |
| CLD[idx] | −150 | −45 | −40 | −35 | −30 | −25 | −22 | −19 | −16 | −13 | −10 |

| | Idx | | | | | | | | | | |
|---|---|---|---|---|---|---|---|---|---|---|---|
| | −4 | −3 | −2 | −1 | 0 | 1 | 2 | 3 | 4 | 5 | 6 |
| CLD[idx] | −8 | −6 | −4 | −2 | 0 | 2 | 4 | 6 | 8 | 10 | 13 |

| | Idx | | | | | | | | |
|---|---|---|---|---|---|---|---|---|---|
| | 7 | 8 | 9 | 10 | 11 | 12 | 13 | 14 | 15 |
| CLD[idx] | 16 | 19 | 22 | 25 | 30 | 35 | 40 | 45 | 150 |

The derived parameter $CLD^1$ describes an energy relation between a channel being a combination of a front-left and a front-right channel and a channel being a combination of a center and a low-frequency-enhancement channel, as can be seen from the channel decomposition in the second hierarchical step 1004. Such, a relative local energy F, describing an energy contained in the front channels, front-left and front-right, can be computed according to the following formula:

$$\mathrm{RelativeLocalEnergy}F_{5151}(l,m)=10\cdot\log10\left(\frac{10^{\left(\frac{D_{CLD}^{Q}(1,l,m)}{10}\right)}}{1+10^{\left(\frac{D_{CLD}^{Q}(1,l,m)}{10}\right)}}\cdot 10^{\frac{\mathrm{RelativeLocalEnergy}FC_{5151}(l,m)}{10}}\right)$$

Previously, a relative local energy S describing the energy of the back channels has been derived such that an intermediate quantized parameter IDX CLD EDQ can be calculated for the hierarchical box 1006 according to the following formulas:

$$idxCLDEdQ(2,l,m)=\max(-15,\min(15,\mathrm{round}(idxCLD(2,l,m)\cdot facFunc(\mathrm{RelativeLocalEnergy}S_{5151}(l,m)))))$$

$$D_{CLD}^{Q}(2,l,m)=deq(idxCLDEdQ(2,l,m),CLD)$$

Since, as previously described, a relative local energy describing the energy of the front-channels only ($F^{5151}$) is now available, parameter $CLD^3$ describing an energy relation between the front-left and the front-right channel can now be derived in an energy-dependent way according to the following formulas:

$$idxCLDEdQ(3,l,m)=\max(-15,\min(15,\mathrm{round}(idxCLD(3,l,m)\cdot facFunc(\mathrm{RelativeLocalEnergy}F_{5151}(l,m)))))$$

$$D_{CLD}^{Q}(3,l,m)=deq(idxCLDEdQ(3,l,m),CLD)$$

In one possible implementation, parameter $CAD^4$ describing an energy relation between the center and the low-frequency-enhancement channel can now be derived using no factor function:

$$D_{CLD}^{Q}(4,l,m)=deq(idxCLD(4,l,m),CLD)$$

In alternative embodiments, it is, of course, also feasible to implement energy-dependency also in the derivation of the parameter $CLD^4$.

FIG. 9*d* shows another possibility of defining a hierarchic for the derivation of the spatial parameters.

In analogy to the description of FIG. 9*c*, the individual CLD-parameters may be derived according to the following formulas:

$$D_{CLD}^{Q}(0,l,m)=deq(idxCLD(0,l,m),CLD)$$

$$\mathrm{RelativeLocalEnergy}LR_{5152}(l,m)=10\cdot\log10\left(\frac{10^{\left(\frac{D_{CLD}^{Q}(1,l,m)}{10}\right)}}{1+10^{\left(\frac{D_{CLD}^{Q}(1,l,m)}{10}\right)}}\right)$$

$$idxCLDEdQ(1,l,m)=\max(-15,\min(15,\mathrm{round}(idxCLD(1,l,m)\cdot facFunc(\mathrm{RelativeLocalEnergy}LR_{5152}(l,m)))))$$

$$D_{CLD}^{Q}(1,l,m)=deq(idxCLDEdQ(1,l,m),CLD)$$

$$\mathrm{RelativeLocalEnergy}L_{5152}(l,m)=10\cdot\log10\left(\frac{10^{\left(\frac{D_{CLD}^{Q}(1,l,m)}{10}\right)}}{1+10^{\left(\frac{D_{CLD}^{Q}(1,l,m)}{10}\right)}}\cdot 10^{\frac{\mathrm{RelativeLocalEnergy}LR_{5152}(l,m)}{10}}\right)$$

-continued $$RelativeLocalEnergyR_{5152}(l, m) = 10 \cdot \log10\left(\frac{1}{1 + 10^{\left(\frac{D^{Q}_{CLD}(1,l,m)}{10}\right)}} \cdot 10^{\frac{RelativeLocalEnergyLR_{5152}(l,m)}{10}}\right)$$

$$D_{CLD}^{Q}(2,l,m)=deq(idxCLD(2,l,m),CLD)$$

$$idxCLDEdQ(3,l,m)=\max(-15,\min(15,\mathrm{round}(idxCLD(3,l,m):facFunc(\mathrm{RelativeLocalEnergy}L_{5152}(l,m))))$$

$$D_{CLD}^{Q}(3,l,m)=deq(idxCLDEdQ(3,l,m),CLD)$$

$$idxCLDEdQ(4,l,m)=\max(-15,\min(15,\mathrm{round}(idxCLD(4,l,m):facFunc(\mathrm{RelativeLocalEnergy}R_{5152}(l,m))))$$

$$D_{CLD}^{Q}(4,l,m)=deq(idxCLDEdQ(4,l,m),CLD)$$

It may be noted that different factor functions may be used to implement the inventive concept as, for example, one of the functions shown in FIG. 5.

Generally, as already mentioned above, it is the inventive concept to apply an energy-dependent quantization in the sense that parameters (CLD) of parts of the signal that contain relatively low energy compared to other signal parts, are quantized in a coarser way. That is, the factor function has to be such that for low energy components, the factor applied is large.

To illustrate this in more detail, one example is given in FIG. 9*e*, which shows the manipulations during encoding and decoding, further pointing out the concept of the invention. Reference is further made to the previously-introduced quantization table to calculate the examples shown.

Table 9*d* shows the manipulation of the quantization index on the quantizer side in a left column 1100, and the reconstruction of the transmitted parameter on the quantizer side in a column 1102. The transmitted parameter is given in column 1104. Two examples for a combination of channels having relatively low energy are shown. This is indicated by the common scale factor 4.5, which is significantly bigger than 1 (see FIG. 4). According to the inventive concept, the quantization index IDX is divided by the scale factor after the quantization at the quantizer size. Afterwards, the result has to be rounded to an integer value to be differentially and Huffman encoded (see FIG. 4*a*). Therefore, both example indexes 10 and 9 result in a transmitted index IDXtransm of 2.

The dequantizer multiplies the transmitted index by the scale factor to derive a rekonstructed index IDXrek used for dequantization. As can be seen in the first example of an index 10 on the quantizer size, an additional error of 1 arises due to the rounding of the divided index on the quantizer size. On the other hand, when, by chance, the division of the scale factor at the quantizer side yields an integer valued index IDXtransm to be transmitted, no additional error is introduced.

Evidently, the danger of introducing additional errors rises with rising scale factor f. This means that the probability of adding additional errors to low energy signals is rather high. When signals described by the CLD parameter in question have comparatively equal energy, the CLD value will be close to unity and such will be the scale factor (see, for example FIG. 5). This means, when the channels for which the parameters are encoded in an energy-dependent manner share roughly the same energy, no additional errors are normally introduced in the quantization. This is, of course, most appropriate, since when every channel has about the same energy within a multi-channel signal, every single channel is audible during simultaneous playback and, therefore, an error introduced would be clearly audible to the audience.

It is evidently an enormous advantage of the present invention that errors are only accepted for channels having comparatively low energy. For those channels, on the other hand, by dividing the indices of the associated parameters by some large numbers brings the index values of those channels closer to zero, on the average. This can be exploited perfectly by the following differential encoding and Huffman encoding procedure to efficiently decrease the bit rate consumed for the transmitted parameters of a multi-channel signal.

The relation of the local and the total energy upon which the decision which de-/quantization rule to use is based, is described to be a logarithmic measure within the previous paragraphs. This of course not the only possible measure that can be used to realize the inventive concept. Any other measure describing an energy difference between the local energy or the total energy, as for example the plain difference, can be used to make the decision.

Another important feature with the present invention is that in combination with a two channel decoder (PS) design that distributes the incoming energy into the two output channels typically controlled by e.g. CLD like parameter (meaning that the incoming energy equals the sum of the energies for the two output channels), is that the difference in energy, Relative Local Energy between the total energy and the local energy for each two channel decoders (122, 124, 126, and 128) is defined by the CLD parameters. This means that there is no need to actually measure the total energy and the local energy since the difference in energy in dB that is typically used to calculate the scale factor is defined by the CLD parameters.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine-readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

The invention claimed is:

1. A parameter dequantizer for dequantizing a quantized parameter to derive a parameter, wherein the parameter is a measure for a characteristic of a single channel or a pair of channels with respect to another single channel or a pair of channels of a multi-channel signal including a plurality of channels, comprising:

a dequantization rule generator for generating a dequantization rule based on a relation between an energy measure derived from the single channel or the pair of channels and an energy measure derived from at least two channels of the multi-channel signal;

a value dequantizer for deriving the parameter from the quantized parameter, using the generated dequantization rule; and the dequantization rule generator or the value dequantizer including a hardware implementation.

2. The parameter dequantizer according to claim 1, in which the dequantization rule generator is operative to use an energy measure derived from at least two channels of the multi-channel signal which is derived from a combination of channels not having the channel or the pair of channels.

3. The parameter dequantizer according to claim 1, in which the dequantization rule generator is operative to generate the dequantization rule such that a dequantization is coarser for a channel or a pair of channels having a low energy measure than for a channel or a pair of channels having a high energy measure.

4. The parameter dequantizer according to claim 1, in which the dequantization rule generator is operative to choose one dequantization rule from two or more fixed dequantization rules stored in a memory.

5. The parameter dequantizer according to claim 1, in which the dequantization rule generator is operative to calculate the new dequantization rule based on a relation between the energy measure derived from the channel or the pair of channels and the energy measure derived from at least two channels of the multi-channel signal.

6. The parameter dequantizer according to claim 1, in which the dequantization rule generator is operative such that the calculation of the dequantization rule comprises a calculation of a scale factor.

7. The parameter dequantizer according to claim 6, in which the dequantization rule generator further comprises a parameter scaler for modifying the parameter using the scale factor.

8. The parameter dequantizer according to claim 6, in which the parameter scaler is operative to modify the parameter such that the modification includes a multiplication of the parameter by the scale factor.

9. The parameter dequantizer according to claim 6, in which the dequantization rule generator further comprises a decompressor for deriving an intermediate quantized parameter from the quantized parameter using the scale factor; and in which the value dequantizer is operative to derive the parameter from the intermediate quantized parameter using a fixed dequantization rule.

10. The parameter dequantizer according to claim 9, in which the decompressor is operative to derive the intermediate quantized parameter by multiplication of the scale factor and the quantized parameter.

11. The parameter dequantizer according to claim 9, in which the dequantization rule generator further comprises a rounder to derive an integer valued intermediate quantized parameter from the intermediate quantized parameter; and in which the value dequantizer is operative to derive the parameter from the integer valued intermediate quantized parameter using a fixed dequantization rule.

12. The parameter dequantizer according to claim 1, in which the quantized parameter is a measure for an energy relation between a combination of a left-front channel and a right-front channel and a combination of a center-channel and a low-frequency-enhancement-channel;

the energy measure is an energy measure for a pair of channels having a first channel combined from the front-left and the front-right channel and having a second channel combined from the center-channel and the low-frequency-enhancement-channel; and the energy measure derived from at least two channels of the multi-channel signal is an energy measure derived from a combination of a back-left and a back-right channel.

13. The parameter dequantizer according to claim 1, in which the quantized parameter is a measure for an energy relation between a back-left and a back-right channel;

the energy measure is an energy measure for a pair of channels having the back-left and the back-right channel; and the energy measure derived from at least two channels of the multi-channel signal is an energy measure derived from a combination of a left-front, a right-front, a center and a low-frequency-enhancement channel.

14. The parameter dequantizer according to claim 1, in which the quantized parameter is a measure for an energy relation between a front-left and a front-right channel;

the energy measure is a measure for a pair of channels having the front-left and the front-right channel; and the energy measure derived from at least two channels of the multi-channel signal is an energy measure derived from a combination of a center and a low-frequency-enhancement channel.

15. The parameter dequantizer according to claim 1, in which the quantized parameter is a measure for an energy relation between a combination of left-front and a left-back channel and a combination of a right-front and a right-back channel;

the energy measure is an energy measure for a pair of channels having a first channel combined from the left-front and the left-back channel and having a second channel combined from the right-front and the right-back channel; and the energy measure derived from at least two channels of the multi-channel signal is an energy measure derived from a combination of a center and a low-frequency-enhancement channel.

16. The parameter dequantizer according to claim 1, in which the quantized parameter is a measure for an energy relation between a left-front and a left-back channel;

the energy measure is an energy measure for a pair of channels having the left-front and the left-back channel; and the energy measure derived from at least two channels of the multi-channel signal is an energy measure derived from a combination of a right-front and a right-back channel.

17. The parameter dequantizer according to claim 1, in which the quantized parameter is a measure for an energy relation between a right-front and a right-back channel;

the energy measure is an energy measure derived from a pair of channels having the right-front and the right-back channel; and the energy measure derived from at least two channels of the multi-channel signal is an energy measure derived from a combination of a left-front and a left-back channel.

18. The parameter dequantizer according to claim 1, in which the dequantization rule generator is operative to generate a dequantization rule such that an application of the dequantization rule to the quantized parameter comprises an assignment of the quantized parameter to a parameter.

19. The parameter dequantizer according to claim 1, further comprising a differential decoder and a Huffman decoder, wherein the Huffman decoder is operative to derive a Huffman decoded representation of a received Huffman encoded representation; and wherein the differential decoder is operative to derive the quantized parameter from the Huffman decoded representation.

20. The parameter dequantizer according to claim 1, in which the parameter is a spatial parameter, describing a spatial perception of the multi-channel audio signal, and in which the input parameter is chosen from the following list of parameters: inter-channel correlation/coherence (ICC), inter-channel level/intensity difference (ICLD or IID), inter-channel phase difference (IPD), and inter-channel time difference (ICTD).

21. A multi-channel decoder for generating a reconstruction of a multi-channel signal, comprising:

a parameter dequantizer according to claim 1; and an up-mixer for up-mixing the reconstruction of the multi-channel signal from a transmitted downmixed signal using parameters dequantized by the parameter dequantizer.

22. A method of dequantizing a quantized parameter to derive a parameter, wherein the parameter is a measure for a characteristic of a single channel or a pair of channels with respect to another single channel or a pair of channels of a multi-channel signal including a plurality of channels, the method comprising:

generating, by a dequantization rule generator, a dequantization rule based on a relation between an energy measure derived from the channel or the pair of channels and an energy measure derived from at least two channels of the multi-channel signal;

deriving, by a value dequantizer, the parameter from the quantized parameter using the generated dequantization rule; and the dequantization rule generator or the value dequantizer including a hardware implementation.

23. A non-transitory storage medium having stored thereon a computer program for performing, when running on a computer, a method in accordance with claim 22.

24. A receiver or audio player, having a parameter dequantizer for dequantizing a quantized parameter to derive a parameter, wherein the parameter is a measure for a characteristic of a single channel or a pair of channels with respect to another single channel or a pair of channels of a multi-channel signal, comprising:

a dequantization rule generator for generating a dequantization rule based on a relation between an energy measure derived from the channel or the pair of channels and an energy measure derived from at least two channels of the multi-channel signal;

a value dequantizer for deriving the parameter from the quantized parameter, using the generated dequantization rule; and the dequantization rule generator or the value dequantizer including a hardware implementation.

25. A method of receiving or audio playing, the method having a method of dequantizing a quantized parameter to derive a parameter, wherein the parameter is a measure for a characteristic of a single channel or a pair of channels with respect to another single channel or a pair of channels of a multi-channel signal, the method comprising:

generating, by a dequantization rule generator, a dequantization rule based on a relation between an energy measure derived from the channel or the pair of channels and an energy measure derived from at least two channels of the multi-channel signal;

deriving, by a value dequantizer, the parameter from the quantized parameter using the generated dequantization rule; and the dequantization rule generator or the value dequantizer including a hardware implementation.

26. A non-transitory storage medium having stored thereon a computer program for performing, when running on a computer, a method in accordance with claim 25.

* * * * *